US006273301B1

(12) United States Patent
Su

(10) Patent No.: US 6,273,301 B1
(45) Date of Patent: Aug. 14, 2001

(54) PERFUME PEN ASSEMBLY STRUCTURE

(76) Inventor: Cheng-Yuan Su, 3rd Fl., 200, Section 3, Sin-Yi Road, Taipei City (TW)

( * ) Notice: Subject to any disclaimer, the term of this patent is extended or adjusted under 35 U.S.C. 154(b) by 0 days.

(21) Appl. No.: 09/537,304

(22) Filed: Mar. 29, 2000

(51) Int. Cl.[7] ..... B67D 5/42
(52) U.S. Cl. ..... 222/321.9
(58) Field of Search ..... 222/321.1, 321.7, 222/321.9

(56) References Cited

U.S. PATENT DOCUMENTS 3,830,404 * 8/1974 Frazer ..... 222/78
3,920,164 * 11/1975 Lindsoe ..... 222/321.9
3,937,366 * 2/1976 Steiman ..... 222/321.9
5,242,089 * 9/1993 Knickerbocker et al. ..... 222/321.7
5,271,532 * 12/1993 Jamel et al. ..... 222/321.9
5,277,340 * 1/1994 Van Brocklin ..... 222/321.7
5,341,956 * 8/1994 Van Brocklin ..... 222/321.9 X
5,492,248 * 2/1996 Ortner ..... 222/321.1 X
5,590,815 * 1/1997 Montaner et al. ..... 222/321.1 X
5,709,324 * 1/1998 Peronnet et al. ..... 222/321.9
5,791,527 * 8/1998 Giuffredi ..... 222/321.9
6,010,039 * 1/2000 Bougamont ..... 222/321.9
6,016,916 * 1/2000 Ortner ..... 222/321.9 X

* cited by examiner

*Primary Examiner*—Kenneth Bomberg
(74) *Attorney, Agent, or Firm*—Dougherty & Troxell

(57) ABSTRACT

This invention is related to an improved perfume pen assembly structure, constructed of a pen body serving as perfume container, the tubular container having an upper half section is formed with an annular, protruding support flange of a shrunk diameter for supporting a pump body provided beneath an atomizing nozzle, the pump body being secured to the support flange of the tubular container by means of a mounting cap, the mounting cap having a sealing diaphragm such that when the mounting cap is forced into the tubular container, the sealing diaphragm forms a seal with an inner wall of the tubular container so as to prevent perfume dissipation. The tubular container has an inner bottom edge that is formed with at least one protruding ring for engaging a groove formed at a corresponding location of an end cap thereby providing securing and sealing effects. The overall structure allows the perfume pen to accommodate various styles and enhances shaping variety. Modulated components further facilitate to reduce manufacturing cost.

1 Claim, 6 Drawing Sheets

PERFUME PEN ASSEMBLY STRUCTURE

DESCRIPTION

This invention is related to an improved perfume pen assembly structure, particular to a portable perfume pen, comprising a pen body serving as a perfume container. An atomizer comprising an atomizing nozzle and a pump body is provided at a tip portion of the pen body for spraying atomized perfume. A pen clip attached to a pen cap is provided to allow a user to clip the pen to a pocket or a pouch to enhance portability. The tubular container of the pen body includes an upper half section that is formed with an annular, protruding support flange of a shrunk diameter for supporting the pump body provided beneath the atomizing nozzle, which is secured to the support flange of the tubular container by means of a mounting cap. The mounting cap has a sealing diaphragm such that when the mounting cap is forced into the tubular container, the sealing diaphragm forms a seal with an inner wall of the tubular container so as to prevent perfume dissipation. The tubular container has an inner bottom edge that is formed with at least one protruding ring for engaging a groove formed at a corresponding location of an end cap thereby providing securing and sealing effects. The overall structure allows the perfume pen to accommodate various styles and enhances shaping variety. Modulated components further facilitate to reduce manufacturing cost. As compared with prior art, the perfume pen of this invention provides a greater variety of styles, colors, integrations, prevents loosening and leakage, and allows easiness in assembling the components.

Perfume is commonly used in enhancing the surrounding aroma in a living or a vehicle environment so as to provide a delightful sense of smell. The most commonly seen perfume is contained in a bottle container, which can be placed on a dressing table or carried in a personal pouch. There also exists a pen-type perfume bottle, the so-called perfume pen that is very popular among youngsters due to its portability and relatively low price. Due to the different consumer populations, the perfume pens are different from those deluxe perfumes used by gentlewomen, who are fastidious about the quality of perfume or the designs of perfume bottles. These perfume pens need to play up to the youngster population that favor colorful and flashy designs at an acceptable expense.

The commonly seen, commercially available perfume pens mostly include a pen body made of glasses for containing the perfume. Though glasses are of finer texture and better appearance, they are liable to fracturing while encountering exterior impact. While most youngsters clip the perfume pens to their collars or pockets, the glasses containers pose a potential threat to their safety due to their highly active life styles. On the other hand, if the pen body is made of plastic materials, the remnants of the runners as a result of injection molding may easily be formed at a bottom end of the pen body so as to affect the overall smoothness and appearance of the pen body, whereas a pen body that is integrally made of glasses or plastic material can only incorporate a singular color.

Furthermore, the atomizer is usually secured to a tip end of a pen body integrally made of glasses or plastic material by means of threads. Frequent playing of the pen or external vibration may easily disengage the threaded engagement so as to subject leakage of the perfume and cause a certain degree of troubles.

In view of the above, the "improved perfume pen assembly structure" of this invention is invented in an attempt to solve the above problems after diligent trials and researches.

It is thus a primary object of this invention to provide an improved perfume pen assembly structure comprising a container portion that is of a penetrated tube. The tube has a bottom end that is capped with an end cap and a tip end that is provided with an atomizer. Engagement of the atomizer is accomplished by resilience of rubber materials in a tight-fitting manner so as to replace the conventional threaded engagement such that the modulated components facilitate to reduce manufacturing cost, and that the components are separated so as to incorporate more than a singular color whereby the final product can render a greater variety of aesthetic appearances.

In order to clearly delineate the objects, characteristics and advantages of the present invention, a few preferred embodiments are specifically explained in detail in accompany with the drawings as follows.

DETAILED DESCRIPTIONS OF EMBODIMENTS

Figure 1:
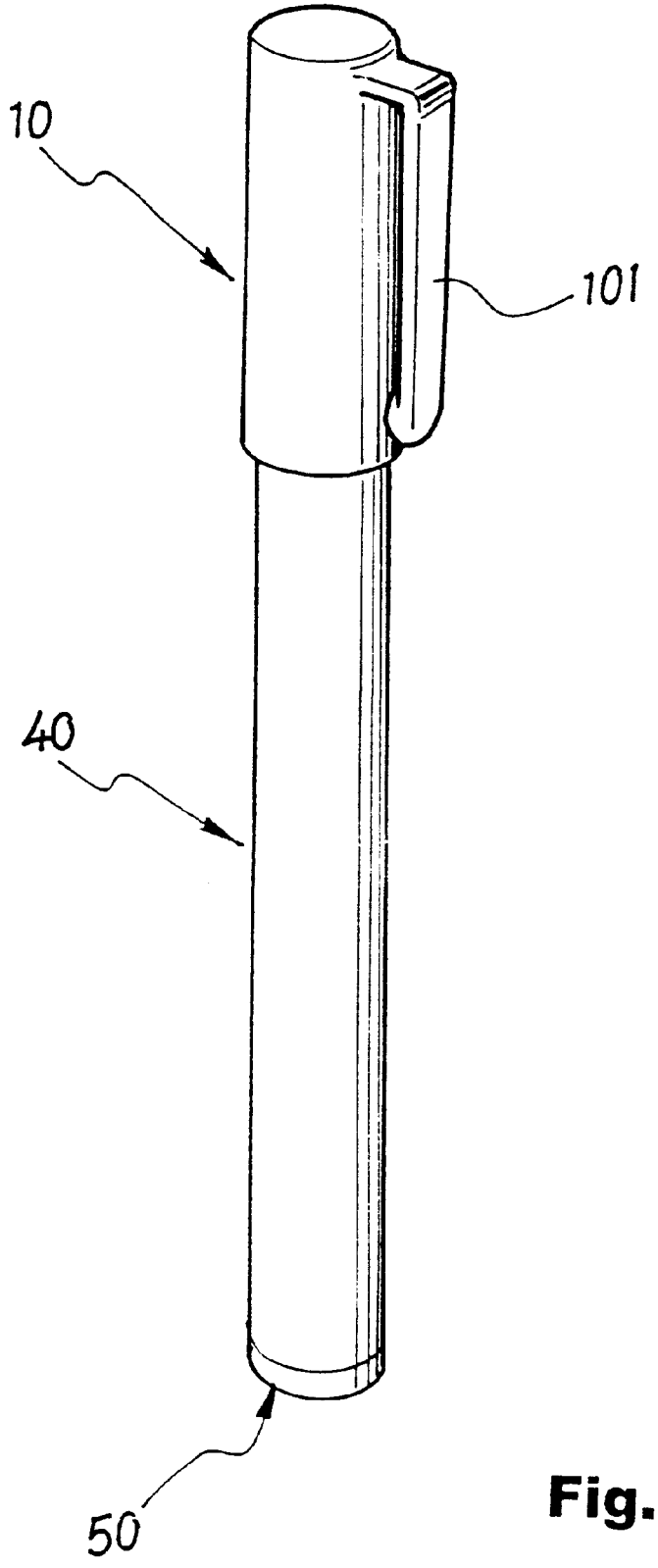
FIG. 1 is a perspective view illustrating an appearance of this invention.
Figure 2:
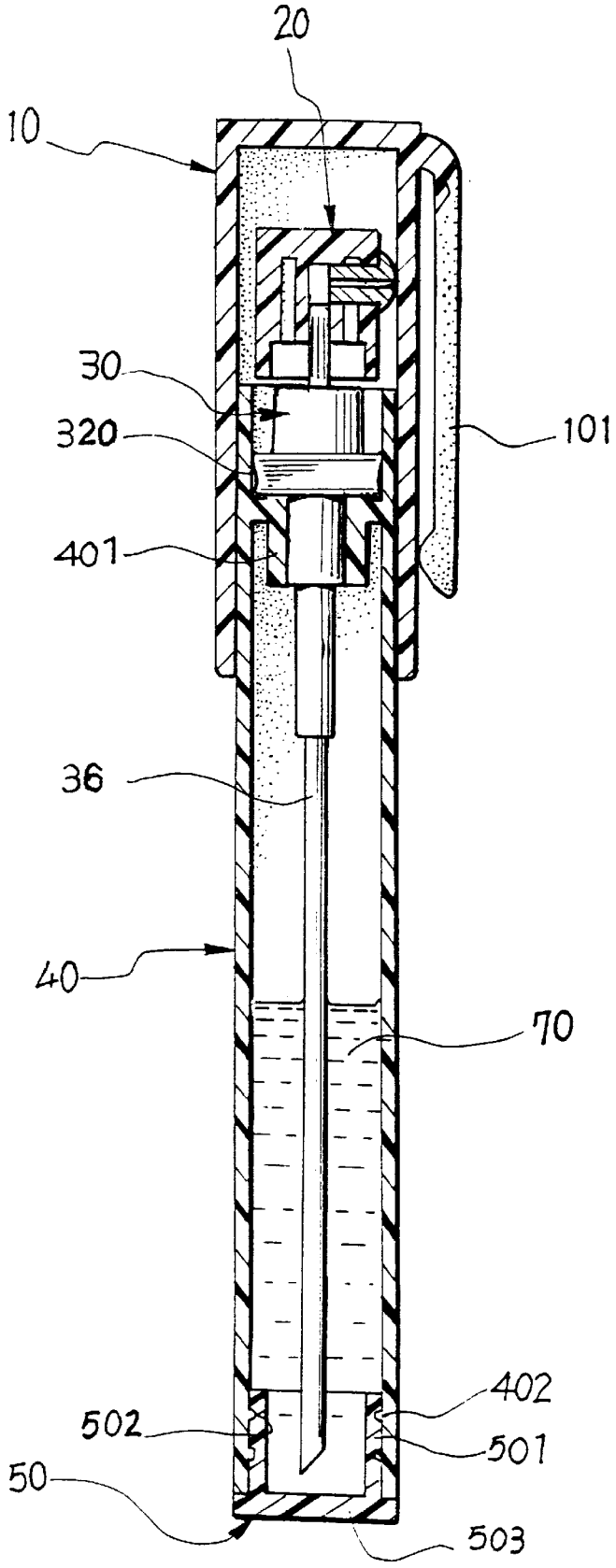
FIG. 2 is an assembled, cross-sectional view of this invention.

This invention is related to an improved perfume pen assembly structure, such as that disclosed in the perspective view of FIG. 1 and the cross-sectional view of FIG. 2, having a substantially pen-shaped configuration. The improved perfume pen assembly structure includes a pen body serling as a perfume container 40. An atomizer comprising an atomizing nozzle 20 and a pump body 30 is provided at a tip portion of the pen body for spraying atomized perfume 70. A pen clip 101 attached to a pen cap 10 is provided to allow a user to clip the pen to a pocket or a pouch to enhance portability.

Figure 5:
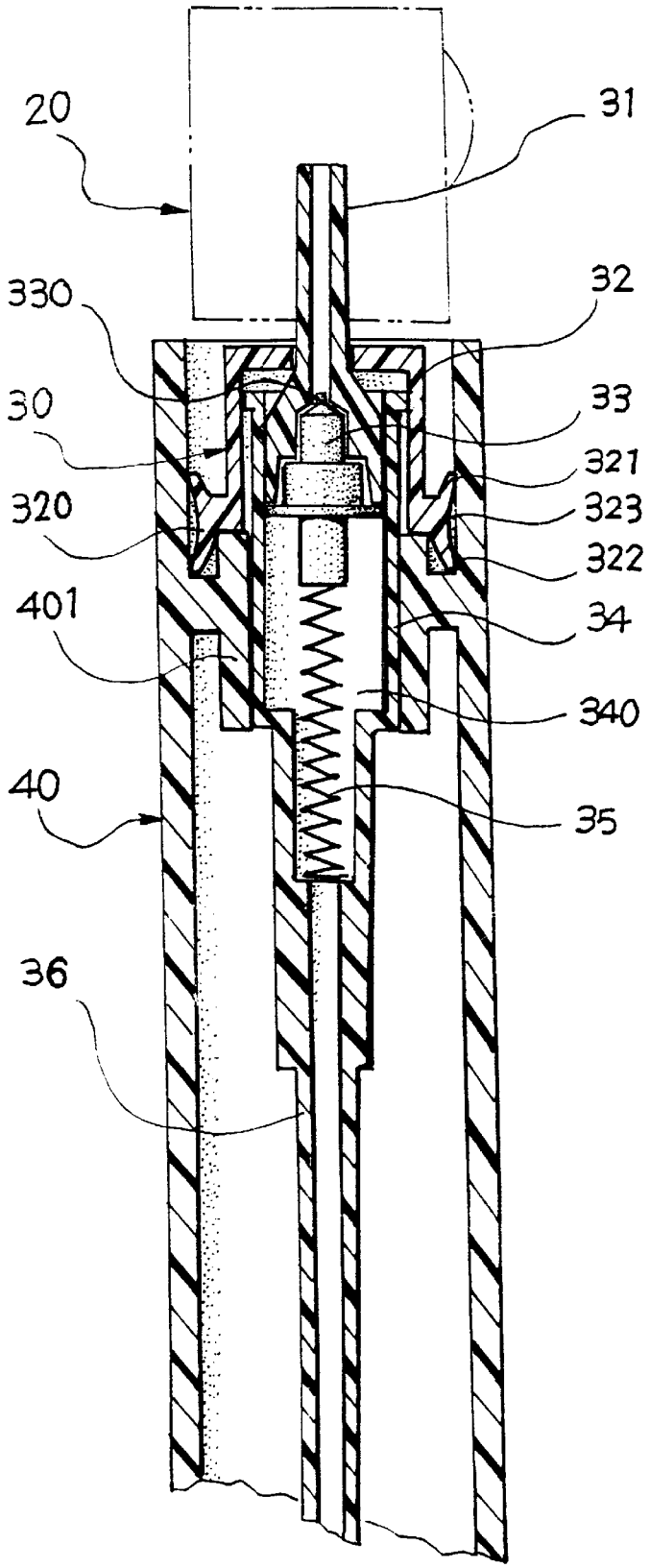
FIG. 5 is a first cross-sectional, enlargement view of a tip end of this invention.

As shown in FIGS. 2 and 5, the pen body includes a tubular container 40. The tubular container 40 has an upper half section that is formed with an annular, protruding support flange 401 of a shrunk diameter for supporting the pump body 30 provided beneath the atomizing nozzle 20, The pump body 30 includes a piston 31, a mounting cap 32, a valve member 33, a cylinder member 34, a spring 35, and a dip tube 36, such that pressing of the atomizing nozzle 20 causes downward movement of the piston 31 and the valve member 33 so as to pump the perfume 70 contained in a pump chamber 340 of the cylinder member 34. When the hydraulic pressure exceeds the spring force which the spring 35 exerts on the valve body 33, the hydraulic pressure will force a swift downward movement of the valve body 33 and release a seal for an opening 330 with the piston 31, thereby spraying the perfume 70 outwards via the opening 330 and the atomizing nozzle 20. At this instance, the hydraulic pressure within the pump chamber 340 diminishes; the spring force that the spring 35 exerts on the valve body 33 re-seals the opening 330; and the dip tube 36 connected to a bottom end of the cylinder 34 pumps and refills the perfume to the pump chamber 340 to prepare for the next pumping motion.

The above pump body 30 is secured to the support flange 401 of the tubular container 40 by means of a mounting cap 32, as shown. The mounting cap 32 has a sealing diaphragm 320. The sealing diaphragm 320 includes an upper diameter 321 that is equivalent to a lower diameter 322 and a significantly smaller medial diameter 323 such that when viewing the sealing diaphragm 320 in its cross-sectional view, a recessed arcuate cross-section is formed. As such, due to the resilience of rubber materials, when the mounting cap 32 is forced into the tubular container 40 in a tight-fitting manner, the recessed arcuate cross-section of the sealing diaphragm 320 facilities to form a seal with an inner wall of the tubular container 49 so as to form a tight seal and to prevent perfume dissipation.

Figure 3:
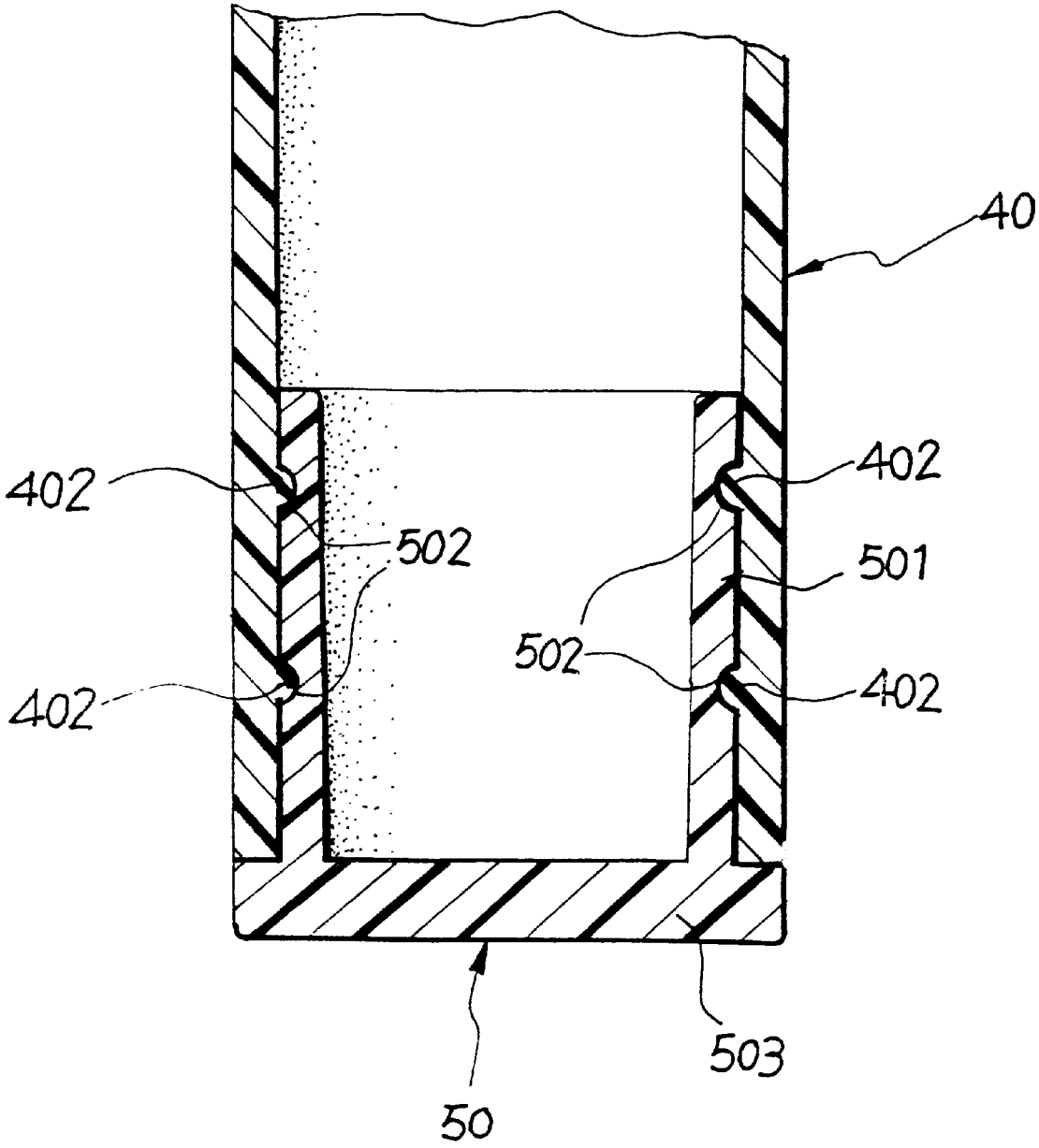
FIG. 3 is a cross-sectional, enlarged view of a bottom end of this invention.

As further shown in FIGS. 2 and 3, the tubular container 40 has an inner bottom edge that is formed with two protruding rings 402 for engaging two grooves 502 formed at corresponding locations of an end cap 50 thereby providing a securing and sealing effects. In the partial enlargement view of FIG. 3, the end cap 5 includes a bottom portion 503 and an engagement portion 501 for tight engagement with the bottom end of the tubular container 40. The engagement portion 501 includes an outer edge that is formed with two grooves 502 corresponding to the two protruding rings 402 whereby when the engagement portion 501 is under a tight-fitting engagement, the resilience of rubber materials facilitates interengagement between the protruding rings and the grooves 502 thereby providing securing and sealing effects. As such, loosening, leakage, and disengagement due to vibration can be prevented such that the end cap can be effectively assembled to the tubular container 40.

Figure 4:
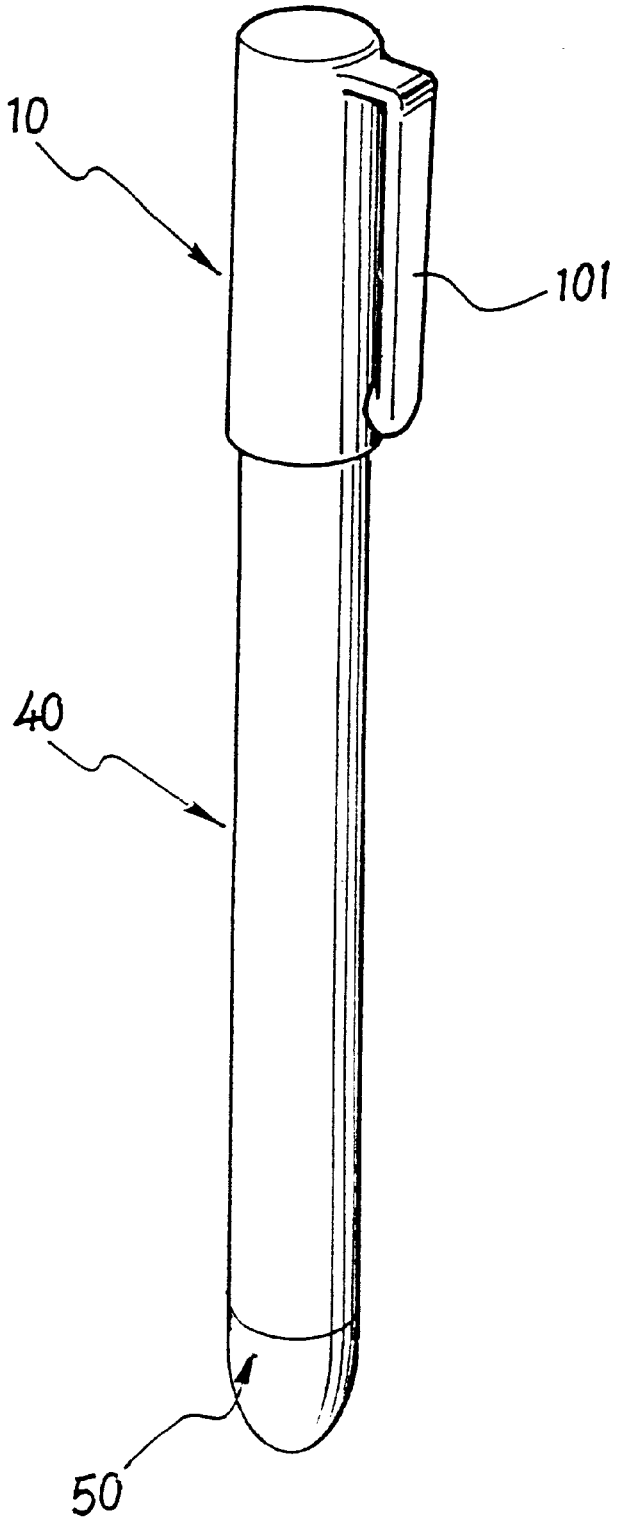
FIG. 4 illustrates an embodiment of this invention.

As shown in FIG. 4, the pump body 30, end cap 50, and tubular container 40 of this invention are designed as modulated components having a streak configuration in lieu of the end cap 50 having a flush bottom end 503 in a conventional perfume pen such as that of FIG. 1. The pump body 30, end cap 50, and tubular container 40 may alternatively be of different colors so as to attain a variety of perfume pens rendering distinguishable visual effects. Therefore, the overall structure of this invention allows the perfume pen to accommodate various styles and enhances shaping variety. Modulated components further facilitate to reduce manufactulring cost. As compared with prior art, the perfume pen of this invention provides a greater variety of styles, colors, integrations, prevents loosening and leakage, and allows easiness in assembling the components.

Figure 6:
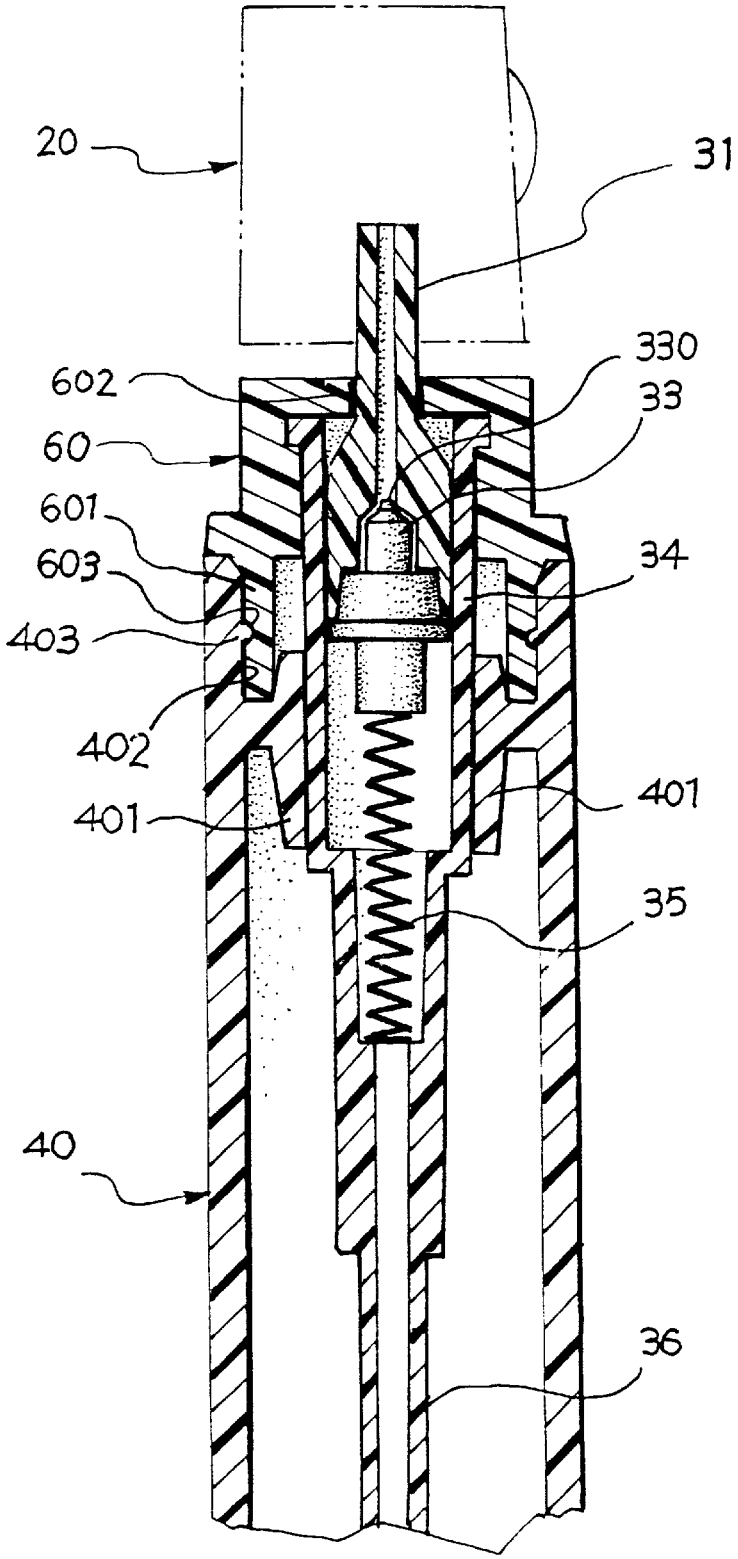
FIG. 6 is a second cross-sectional, enlargement view of a tip end of this invention.

Illustrated in FIG. 6 is an alternative embodiment of this invention, where the upper half section of the tubular container 40 is formed with a protruding ring 403 having functions similar to the protruding ring 402 provided at the inner bottom edge of the tubular container 40 so as to allow an inversed U-shaped tip cap 60 (an replacement of the mounting cap 32) to engage over a tip end of the container 40, thereby securing the pump body 30 therein and providing securing and sealing effects. The tip cap 60 includes a lower end that is provided with a lower sleeve 601. The lower sleeve 601 is provided around an outer sleeve wall thereof with an annular groove 603 for engaging the protruding ring 403 so as to provide securing and sealing effects. The tip cap 60 includes a tip end that is provided with an opening 602 through with the piston member 31 passes to engage the atomizing nozzle 22 thereby further enhancing the sealing effect.

In summary, the "improved perfume pen assembly structure" of this invention discloses a novel, simple, low cost structure. The value of the products made in accordance with this invention can be further enhanced by the greater variety of colors and shaping designs so as to play up to the youngster population that favor colorful and flashy designs. This invention is thus a valuable improvement. A patent is hereby submitted and patent rights are respectfully solicited to be granted thereto.

What is claimed is:

1. An improved perfume pen assembly structure having a substantially pen-shaped configuration, comprising a pen cap, an atomizing nozzle, a pump body, a tubular container, and an end cap, wherein the pen body serves as a perfume container, the pump body and atomizing nozzle are provided at a tip portion of the pen body for spraying atomized perfume, the pen cap is provided with a pen clip to allow a user to clip the pen to a pocket or a pouch for convenient transport, characterized in that:

the tubular container of the pen body includes an upper half section that is formed with an annular, protruding support flange of a shrunk diameter for supporting the pump body provided beneath the atomizing nozzle; the tubular container includes an lower half section that is formed an inner bottom edge thereof with at least one protruding ring for engaging the end cap being inserted to the lower half section;

the pump body including a piston, a mounting cap, a valve member, a cylinder member, a spring, and a dip tube, is secured to the supporting flange of the tubular container, the mounting cap having an upper diameter and a lower diameter equivalent to one another and a significantly smaller medial diameter so as to form sealing diaphragm having a recessed arcuate cross-section, such that when the mounting cap is forced into the tubular container in a tight-fitting manner, the recessed arcuate cross-section of the sealing diaphragm facilities to form a seal with an inner wall of the tubular container so as to prevent perfume dissipation; and the end cap includes a bottom portion and an engagement portion for tight engagement with a bottom end of the tubular container, the engagement portion including an outer edge that is formed with at least one groove corresponding to the protruding ring, whereby a tight-fitting engagement of the engagement portion causes inter-engagement between the protruding ring and the groove thereby providing securing and sealing effects.

* * * * *